United States Patent [19]

Scheinecker et al.

[11] 4,085,793

[45] Apr. 25, 1978

[54] PLATE MOULD HAVING TWO TILTABLY ADJUSTABLE END WALLS

[75] Inventors: Alois Scheinecker, Linz; Karl Koller, St. Polten; Günter Holleis, Linz, all of Austria

[73] Assignee: Vereinigte Osterreichische Eisen- und Stahlwerke - Alpine Montan Aktiengesellschaft, Vienna, Austria

[21] Appl. No.: 741,548

[22] Filed: Nov. 15, 1976

[30] Foreign Application Priority Data

Nov. 24, 1975 Austria ..... 8908/75

[51] Int. Cl.[2] ..... B22D 11/00; B22D 11/124

[52] U.S. Cl. ..... 164/436; 164/443

[58] Field of Search ..... 164/82, 273 R, 283 R, 164/283 S, 283 M, 280, 436

[56] References Cited

U.S. PATENT DOCUMENTS

| | | | |
|---|---|---|---|
| 3,292,216 | 12/1966 | Colombo | 164/273 R |
| 3,439,736 | 4/1969 | Strohschein | 164/273 R |
| 3,583,473 | 6/1971 | Strohschein | 164/273 R |
| 3,710,845 | 1/1973 | Burkhardt | 164/273 R |
| 3,717,197 | 2/1973 | Strack | 164/280 X |
| 3,913,658 | 10/1975 | Schmid | 164/280 |
| 3,964,727 | 6/1976 | Gladwin | 164/280 X |

*Primary Examiner*—Francis S. Husar
*Assistant Examiner*—John S. Brown
*Attorney, Agent, or Firm*—Bierman & Bierman

[57] ABSTRACT

A plate mould with a rectangular cross-section for continuously casting steel slabs has end walls that are tiltably adjustable and two adjustment drives at each end wall and link plates connecting each end wall and its pertaining adjustment drives in a four-bar-linkage manner.

6 Claims, 4 Drawing Figures

PLATE MOULD HAVING TWO TILTABLY ADJUSTABLE END WALLS

The invention relates to a plate mould having a rectangular cross-section for continuously casting steel slabs, the end walls of the mould being tiltably adjustable, i.e. at an angle to each other, and two adjusting drives being articulately connected to each end wall.

For making steel slabs, advantageously plate moulds are used, whose broad-side walls and end walls can be adjusted to the respective size of the slab to be cast, whereby the number of moulds to be kept on store is substantially reduced. The walls of the mould are designed to be at a slight angle, so that also in the lower part of the mould a tight contact with the strand and thus a good heat dissipation is safeguarded.

It has been known to insert the end walls between the broad-side walls, whereupon the broad-side walls have been pressed towards each other. Therein the inclination of each end wall is adjustable by two adjustment spindles arranged one above the other which are hinged to the end wall by one spherical joint each. The inclination of the broad-side walls results in dependence upon the shape of the end walls which the broad-side walls contact. Such a construction is shown, for example in U.S. Pat. No. 3,292,216, issued Dec. 20, 1966.

When the end walls are readjusted for changing the width of the mould or the inclination of the end walls in such an arrangement, and when due to thermal stress on the broad-side walls the length of the broad-side walls changes, there is the danger that the end walls get into a slanted position due to the friction present between them and the broad-side walls, or that they get stuck or jam, i.e. that the right angle required between the broad-side walls and the end walls cannot be maintained. Thus strains causing substantial deformations in parts of the mould can occur on the adjustment drives.

The invention aims at preventing these disadvantages and difficulties and has as its object to create a mould of the above defined kind, wherein the end walls are movable relative to the adjustment drives, wherein, however, the right angle between the end walls and broad-side walls may be maintained.

According to the invention, this object is achieved in that each end wall of the mould is connected with the two adjustment drives engaging with them by link plates hinged to each end wall and to the adjustment drives in a four-bar-linkage manner. Thus it is also prevented that, when the inclination of the end walls changes, the spindles get into a slanted position relative to each other and jam in their drives.

For a better movability of the link plates, they are journaled on the end wall of the mould and on the adjustment drives with lateral play.

Advantageously, the links of the four-bar linkage are formed in that the adjustment drives and the end walls are provided with linkage bolts on which the link plates are journaled by means of articulation bearings.

In order to be able to keep the end walls arranged movable relative to the adjustment spindles at the correct height, the end walls of the mould are provided at their upper edge with a web protruding over the upper edges of the two broadside walls of the mould.

According to a preferred embodiment, each of the two adjustment drives, in particular threaded spindles, hinged to an end wall of the mould is connectable via one gear each and via a common linkage shaft by a coupling, wherein, when in connected position, both adjustment drives together, and when in disengaged position, only one adjustment drive, can be driven.

The invention shall now be described by way of example only and with reference to the accompanying drawings, wherein.

A water box of a mould is denoted by 1, at which water box broad-side walls 2 and end walls 3 are arranged. At the sides facing each other, the mould walls 2, 3 carry the copper plates 2', 3' for contacting the melt. The broad-side walls are adjustable in direction towards and away from each other by adjustment drives 4 mounted on the water box and can be braced relative to each other by means of fixing spindles 5, so that the end walls 3 inserted between the broad-side walls are clamped.

Figure 1:
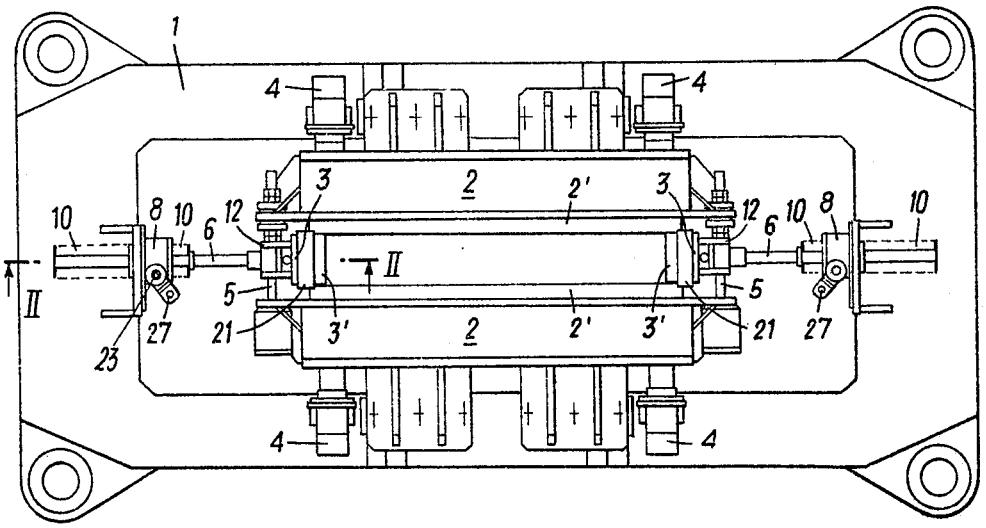
FIG. 1 is a top view on a mould in schematical illustration.
Figure 3:
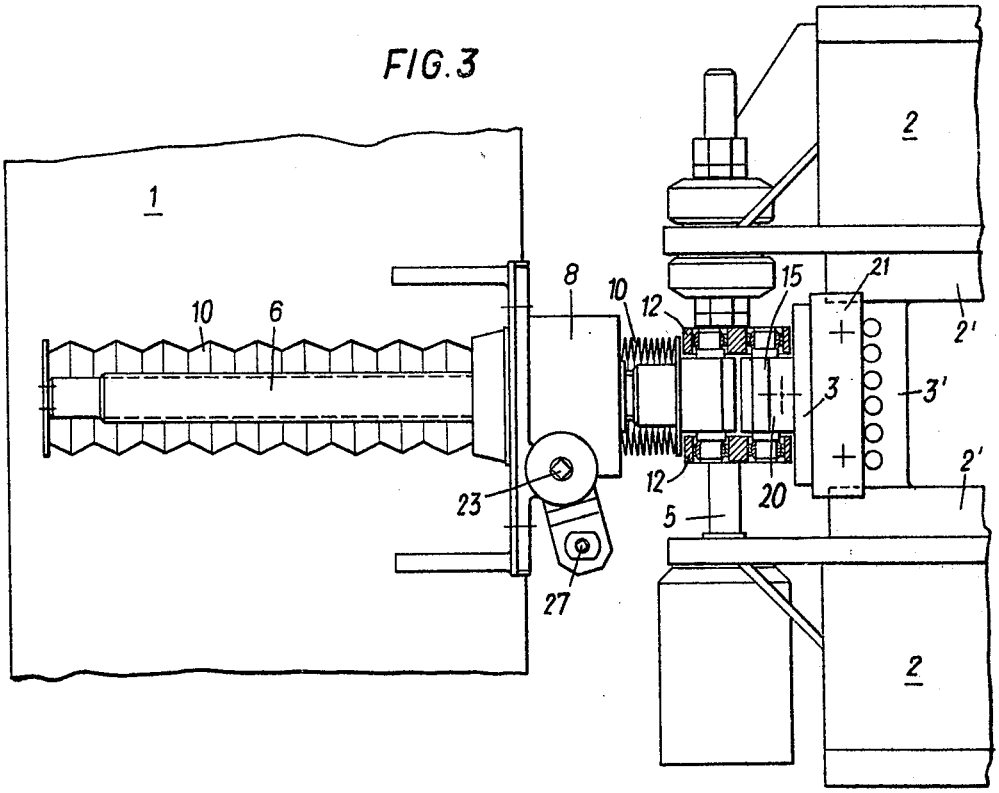
FIG. 3 is a view in the direction of the arrow III of FIG. 2, partly in section.
Figure 2:
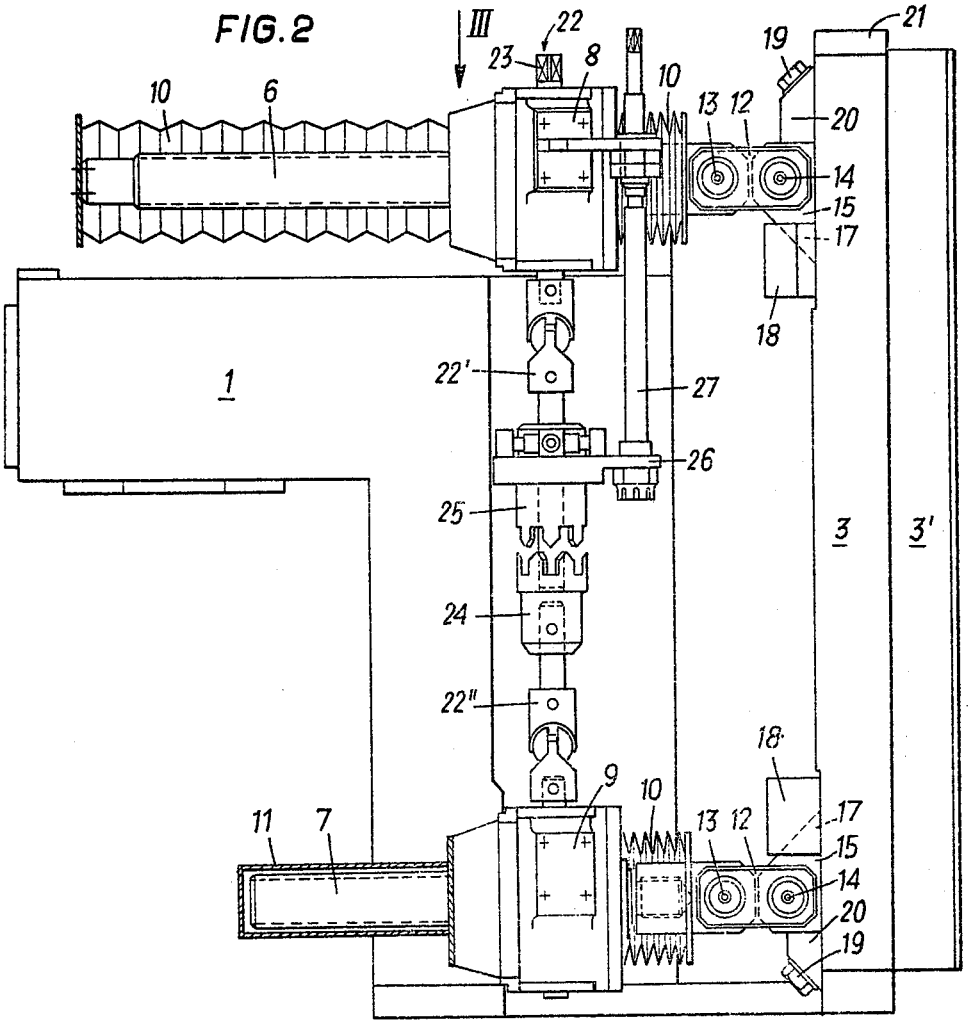
FIG. 2 is a partial section along line II—II of FIG. 1 on an enlarged scale.

For displacing and adjusting the inclination of each end wall, there are provided two threaded spindles 6, 7 arranged one above the other as shown in FIG. 2, which are respectively housed in gear boxes 8, 9 fastened to the water box 1. Instead of the threaded spindles also toothed racks can be provided. The portions of the threaded spindles protruding from the gear boxes are protected against dirt by bellows-type means 10 and cylindrical bushings, 11, respectively. Each threaded spindle 6, 7, with its end facing the end wall 3 is articulately connected with the respective end wall via two link plates 12 arranged lateral thereof. Thus the end wall 3 of the mould forms with link plates 12 and the fixed distance between spindles 6 and 7, a four-bar linkage permitting vertical movement of the end wall relative to the two spindles.

Figure 4:
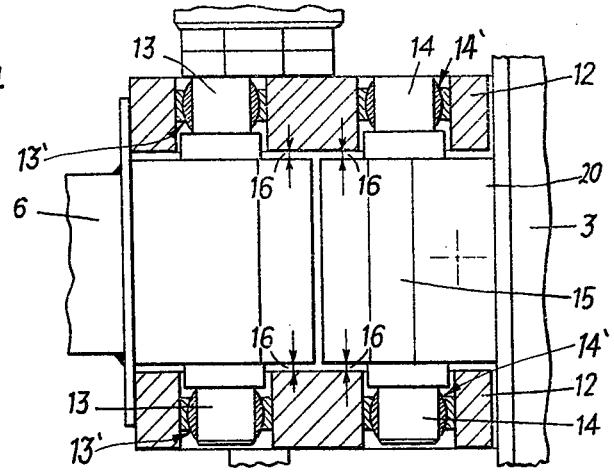
FIG. 4 shows a top sectional view of a portion of FIG. 3 on an enlarged scale.

As can be seen from FIG. 4 in particular, the link plates 12 also are hinged to the end of the threaded spindle 6 by linkage bolts 13 via articulation bearings 13', and to a linkage head 15, clamped at the end wall 3, by bolts 14 via articulation bearings 14'. A play 16 is thus provided on the one hand between the link plates 12 and the block at the end of spindle 6, and on the other hand between said link plates and the linkage head 15 enabling a lateral parallel displacement of the end wall 3. Thereby uneven areas in the broad-side wall caused, e.g., by wear can be balanced. A tilting of the end wall 3 around an axis parallel to the axis of the mould is prevented by the arrangement of the link plates 12 at both sides of the spindles 6, 7 and linkage heads 15, so that a displacement of the end wall 3 relative to the broad-side walls becomes possible without jamming and while maintaining the right angle present between the walls.

The linkage heads 15 have catch-like projections or noses 17 insertable into corresponding recesses of a counter-piece 18 rigidly secured to the end wall. By the bracing screws 19 slantedly directed to the middle of the mould, one bracing piece 20 each is pressed against the linkage head 15, which thus is brought into contact with the end wall 3 and fixed thereon. The link plates hinged, on the one hand, to the spindles 6, 7, and, on the other hand, to the end wall 3, form a four-bar linkage, whose axes are directed to be parallel to the end wall and perpendicular to the axis of the mould, whereby the end wall is movable parallel to the plane of symmetry which extends perpendicularly to the end walls. At the upper end of each end wall there is fastened a web 21 reaching over the upper edges of the broad-side walls and resting thereon, whereby the end walls are kept at the correct height in each position.

The threaded spindles 6 and 7 of each end wall are displaceable by a common linkage shaft 22, whose axis is arranged approximately at right angles to the axes of the spindles 6, 7 to cross them. The linkage shaft has two portions, and one portion 22', 22'' each is in operative connection via a gear 8, 9 with one of the spindles 6, 7 via bevel wheels (not shown). Portion 22' engaging with the upper spindle 6 penetrates the gear and is provided with a square 23 at its upper end, upon which square a crank handle can be slipped. The two portions 22' and 22'' of the linkage shaft can be connected by a claw coupling, whereby both spindles 6, 7 can be driven simultaneously. Thus the end walls are parallelly displaceable. In the disengaged position, only the upper spindle 6 is drivable via the linkage shaft 22, the lower portion 22'' of the linkage shaft and the spindle 7 being in operative connection therewith stand still. In this position, which is shown in FIG. 2, it is possible to adjust the inclination of each end wall 3 by readjusting the spindle 6. The ascent of the thread of the threaded spindles is smaller than the pertaining angle of friction, so that due to this automatic lock a displacement of the end walls during operation cannot occur. The coupling consists of a rigid coupling half 24 and a liftable coupling half 25. A lifting ring 26 engages with the coupling half 25, which lifting ring can be lifted or lowered by rotating the lifting spindle 27. The side walls 2, 3 of the mould are provided in common manner with connecting means for coolant supply and removal, which are not illustrated.

We claim:

1. In a plate mould, having two tiltably adjustable end walls and two broad-side walls to give the plate mould a rectangular cross-section, for continuously casting steel slabs, and two adjustment drives hinged to opposed end portions of each one of said said two end walls, the improvement which comprises a pair of parallel link plates hinged to a respective one of said two adjustment drives as well as to a respective end wall, to connect each one of said end walls with a two adjustment drives engaging thereat in a four-bar-linkage manner.

2. A plate mould as set forth in claim 1, wherein the link plates are journaled with lateral play on the respective end wall and on the two adjustment drives pertaining thereto.

3. A plate mould as set forth in claim 1, further comprising linkage bolts provided on the adjustment drives and on the end walls and articulation bearings for mounting the link plates on said linkage bolts.

4. A plate mould as set forth in claim 1, wherein each end wall has an upper edge provided with a web protruding over the upper edges of the broad-side walls.

5. A plate mould as set forth in claim 1, further comprising one gear provided for each of the two adjustment drives, a common linkage shaft and coupling means, the two adjustment drives being connectable via said gears, said common linkage shaft and said coupling means, and wherein in connection position both of the two adjustment drives are commonly drivable and in disengaged position only one adjustment drive is drivable.

6. A plate mould as set forth in claim 5, wherein each adjustment drive comprises a threaded spindle.

* * * * *